United States Patent [19]

Spars

[11] 4,376,015

[45] Mar. 8, 1983

[54] PROCESS FOR REMOVING ARSENIC FROM GREEN COKE DERIVED FROM SHALE OIL

[75] Inventor: Byron G. Spars, Mill Valley, Calif.

[73] Assignee: Chevron Research Company, San Francisco, Calif.

[21] Appl. No.: 292,731

[22] Filed: Aug. 14, 1981

[51] Int. Cl.[3] ..... C10B 53/00; C10B 57/00; C10G 17/00

[52] U.S. Cl. ..... 201/17; 208/53; 208/251 R

[58] Field of Search ..... 201/17, 41; 208/50, 208/53, 251 R, 177

[56] References Cited

U.S. PATENT DOCUMENTS

| | | | |
|---|---|---|---|
| 3,933,624 | 1/1976 | Myers | 208/89 |
| 4,011,303 | 3/1977 | MacGregor | 201/17 |
| 4,029,571 | 6/1977 | Curtin | 208/89 |
| 4,083,924 | 4/1978 | Styring | 208/251 R |
| 4,146,434 | 3/1979 | Alford et al. | 201/17 |
| 4,181,596 | 1/1980 | Jensen | 208/251 R |
| 4,188,280 | 2/1980 | Jensen | 208/53 |

FOREIGN PATENT DOCUMENTS

| | | | |
|---|---|---|---|
| 2726490 | 12/1978 | Fed. Rep. of Germany | 208/251 R |

OTHER PUBLICATIONS

"About Coke-and Where the Sulfur Went"; Chemtech; vol. 7; No. 6; pp. 366-373; 6/77.

*Primary Examiner*—Bradley Garris
*Attorney, Agent, or Firm*—Burns, Doane, Swecker & Mathis

[57] ABSTRACT

Arsenic is removed from green shale oil coke of high arsenic content by calcining the coke at 1500° F. to 3000° F. for 0.1 hr to 4 hr. The arsenic content is reduced from above about 150 to 300 ppm to below about 100 ppm, thereby making the coke suitable for use as a fuel, in electrodes for producing aluminum, or in steel making.

8 Claims, No Drawings

PROCESS FOR REMOVING ARSENIC FROM GREEN COKE DERIVED FROM SHALE OIL

BACKGROUND OF THE INVENTION

1. Field of the Invention

The invention relates to a calcining process for removing arsenic from green coke made from shale oil containing at least about 10 ppm arsenic.

2. Description of the Prior Art

Oil obtained from oil shale typically has a relatively high arsenic content compared with petroleum oil. The presence of arsenic in crude shale oil makes it an undesirable feedstock for a conventional refinery because organoarsenic compounds form complexes with many of the metals used in refining catalysts, thereby poisoning the catalysts. Also, arsenic is a potential health hazard and deposits easily causing scaling and plugging of lines, tubes, packings, trays and other equipment. In view of this many techniques have been devised to remove arsenic from shale oil. For instance, U.S. Pat. No. 4,029,571 describes a thermolytic process in which the shale oil is heated under conditions that maintain most of the oil in a liquid phase but cause the formation of a small amount of precipitate in which the arsenic is concentrated. The precipitate is removed from the fluid by conventional solid-liquid separation techniques.

Crude shale oil is also often upgraded to improve its pour point and viscosity. Various conventional upgrading processes, including coking, have been suggested or used. In this regard pages 125–132 of the *Synthetic Fuels Data Handbook,* Cameron Engineers, Inc., 1975 describes coking processes for shale oil and reports analyses of the distillate and coke products from coking tests on shale oil feedstocks. The arsenic content of the coke is not indicated and there is no mention of further treatment of the coke.

Several patents describe processes for calcining green coke made from petroleum oil for the purpose of removing volatile hydrocarbons and/or sulfur from the green coke. U.S. Pat. No. 3,369,871 describes such a process in which green petroleum coke is first treated with oxygen to oxidize sulfur in the coke and then calcined at elevated temperatures in a non-oxidizing atmosphere. U.S. Pat. No. 3,933,596 describes another such process in which the green coke is mixed with a small amount of sodium cabonate and heated followed by contact with a desulfuring gas at elevated temperatures. Other processes for calcining petroleum oil coke are described in U.S. Pat. Nos. 4,100,265 and 4,146,434. None of these patents mention coke derived from shale oil.

SUMMARY OF THE INVENTION

The invention is a process for removing arsenic from green coke obtained by coking shale oil containing at least about 10 ppm arsenic comprising calcining the green coke at a temperature in the range of about 1500° F. to about 3000° F. for a time sufficient to reduce the arsenic content of the coke to below about 100 ppm.

DETAILED DESCRIPTION OF THE INVENTION

The coke that is treated according to the invention is made from a shale oil feedstock that contains at least about 10 ppm arsenic, usually in the range of about 10 ppm to about 50 ppm arsenic, and more usually in the range of about 15 ppm to about 30 ppm arsenic. Such feedstocks are made from oil shale of correspondingly high arsenic content by retort processes that pyrolize the kerogen in the shale. The feedstock may comprise whole raw shale oil, the high boiling portion of the raw shale oil, fractions thereof, or mixtures of such shale-derived oil with conventional petroleum feedstocks. In addition to arsenic these feedstocks may also contain significant amounts of other contaminants, such as selenium and sulfur that may also concentrate in the coke and be removed by the invention process. The whole raw shale oil feedstock will typically have the properties shown below.

| Shale Oil Feedstock | |
|---|---|
| Gravity, API | 16–28 |
| Pour Point, °F. | 30–100 |
| Arsenic Content, ppm | 10–50 |
| Total Solids Content, wt % | 0.001–0.1 |
| ASTM D1160 Distillation, °F. | |
| st/10 | 200–275–300–520 |
| 50 | 650–810 |
| 90/EP | 850–1060–1000 |
| % Overhead | 98–90 |

Well known coking processes such as delayed coking and fluidized coking may be used to prepare green coke from the shale oil feedstock. The delayed coking process is preferred. In the delayed coking process the shale oil feedstock is heated in a furnace to cracking temperatures, typically in the range of 850° F. to 1100° F., and fed continuously into an insulated coking drum, usually operated at pressures of about 10 to 150 psig and vapor effluent temperatures of about 700° F. to about 900° F. The feed accumulates in the drum and heat soaks causing some molecules to crack into lower boiling fragments and others to combine or polymerize into coke. The lower boiling products vaporize and are taken off overhead. The coke accumulates in the drum. Usually two or more drums are operated in parallel so that when one fills the furnace effluent can be diverted to the other while coke is removed from the filled drum.

The particular properties of the green oil shale coke prepared by the delayed coking process will vary with the feedstock and the operating variables employed in the coker unit. The coke will consist predominantly of high molecular weight, i.e. >3000 mw, polyaromatics. It will usually contain about 5% to about 15% by weight volatiles (as determined by ASTM D3175.). During the coking the arsenic compounds in the feedstock concentrate in the coke. Accordingly, the coke will usually contain more than about 100 ppm arsenic, more usually about 150 to 300 ppm arsenic. The usual composition of green coke made from high arsenic content shale oil by the delayed coking process is summarized below.

| Green Coke Composition | |
|---|---|
| Proximate Analysis | |
| Volatiles | 8 to 13 wt. % |
| Fixed Carbon | 87 to 92 wt. % |
| Ash | 0.01 to 0.05 wt. % |
| Ultimate Analysis | |
| Hydrogen | 3.5 to 4.5 wt. % |
| Carbon | 87 to 92 wt. % |
| Sulfur | 0.3 to 1.0 wt. % |
| Arsenic | 100 to 300 ppm |

Volatiles, arsenic, and other contaminants in the green coke are removed by calcining the coke at temperatures in the range of about 1500° F. to about 3000° F., preferably 2500° F. to 3000° F., for a time sufficient to reduce the arsenic content to below about 100 ppm, preferably below about 50 ppm. At such temperatures the time required to reduce the arsenic content of the coke to below 100 ppm will typically be in the range of 0.1 to 4 hr, more usually about one quarter to two hr. The calcining may be carried out in electric calciners or in gas or oil-fired calciners such as the known rotating cylinders and rotating hearths.

A rotating cylinder calciner consists of a refractory-lined steel shell kiln that rotates slowly on an inclined—nearly horizontal axis. Raw coke is fed into the upper end of the kiln. The other end of the kiln is fired with gas or oil so that movement of the coke is countercurrent to the hot gases. Volatiles in the raw coke burn and supply an appreciable part of the total energy required. The size and inclination of the kiln, rate of rotation, and feed rate determine throughput.

In a rotating hearth calciner, the coke is fed to the outer periphery of a rotating hearth. Fixed rakes cause the coke to move toward the center where the coke travels down a shaft to a cooling section and thence out of the kiln. Air is introduced into the space above the rotating hearth which space is confined by a fixed refractory-lined dome. Heat for the calcination is derived from the combustion of the volatile matter given off by the coke. There are several types of electric calciners. They are described in the *Encyclopedia of Chemical Technology,* Kirk-Othomer, 2nd Ed., Vol. 4, p. 171.

The arsenic compounds are removed from the coke during the calcination and are removed from the calcination apparatus with the effluent gases. The effluent gases may be scrubbed or otherwise treated to remove the arsenic and other toxic or noxious contaminants. The calcined coke product will usually be at least metallurgical grade and may be used in electrodes for producing aluminum, steel manufacture, or as a fuel. In this regard, if the arsenic had not been removed from the green shale oil coke, it would not be suitable for use in applications in which the arsenic might be evolved to the atmosphere.

The following example further illustrates the invention. This example is not intended to limit the invention in any manner. Unless indicated otherwise, percentages are by weight. In this example, the feedstock was a shale oil produced by the modified in-situ process and having the following analysis:

| | | |
|---|---|---|
| Gravity, °API | 25.0 | ASTM D1160 Distillation, °F. |
| Pour Point, °F. | +25 | st/10 270/472 |
| Arsenic content, ppm | 18 | 50 661 |
| Wt % Sulfur | 0.58 | 90/EP 865/954 |
| Wt % Nitrogen | 1.45 | Recovered 98.5% |

This feedstock was coked in a batch unit. The stillpot temperature was gradually raised to a maximum temperature of 975° F. and maintained at this point until no additional gas or liquid was being evolved.

The analysis of the green coke was as follows:

| Green Coke Analysis | | |
|---|---|---|
| Real density 1.462 g/cc | Arsenic | 220ppm |
| Moisture (ASTM D-3173) 0.75% | Sulfur | 0.72% |
| Volatiles (ASTM D-3175) 6.54% | Nitrogen | 2.58% |

Four portions of the green coke were calcined by placing them in a calcining furnace under a nitrogen atmosphere and heating them to 2000° F., 2400° F., 2700° F., and 2900° F., respectively, for 1 hr. The portions were allowed to cool and assayed for arsenic. The results of the assays are reported below.

| Calcining Temp. °F. | Arsenic Content, ppm |
|---|---|
| 2000 | 110 |
| 2400 | 70 |
| 2700 | 150 |
| 2900 | 52 |

The arsenic assay for the test run at 2700° F. is clearly anomalous. Otherwise, the reported results show that arsenic may be removed effectively from green oil shale coke by calcining it under the reported conditions. Higher temperatures and/or longer calcining times would yield an even greater reduction in the arsenic content of the coke.

Modifications of the above described embodiments of the invention that are obvious to those of ordinary skill in the refining, chemical processing, and related arts are intended to be within the scope of the following claims.

I claim:

1. A process for removing arsenic from green coke obtained by coking shale oil containing at least about 10 ppm arsenic comprising calcining the green coke at a temperature in the range of about 1500° F. to about 3000° F. for a time sufficient to reduce the arsenic content of the coke to below about 100 ppm.

2. The process of claim 1 wherein the green coke contains at least about 150 to about 300 ppm arsenic.

3. The process of claim 1 wherein the green coke is obtained by subjecting the shale oil to delayed coking.

4. The process of claim 1 wherein the temperature is in the range of about 2500° F. to about 3000° F.

5. The process of claim 4 wherein the time is in the range of about 0.1 hr. to about 4 hr.

6. The process of claim 1 or 4 wherein the shale oil contains about 15 ppm to about 30 ppm arsenic.

7. The process of claim 1 wherein the arsenic content of the calcined coke is below about 50 ppm.

8. The process of claim 1 wherein the green coke is obtained by subjecting the shale oil to delayed coking, the green coke contains about 150 to about 300 ppm arsenic, the temperature is in the range of about 2500° F. to about 3000° F., the time is in the range of about 0.1 hr. to 4 hr., and the arsenic content of the calcined coke is below about 50 ppm.

* * * * *